United States Patent [19]

Förster et al.

[11] Patent Number: 5,063,995

[45] Date of Patent: Nov. 12, 1991

[54] CERAMIC HEAT EXCHANGER

[75] Inventors: Siegfried Förster, Ottenfeld; Peter Quell, Birkenweg, both of Fed. Rep. of Germany

[73] Assignee: Forschungszentrum Jülich GmbH, Jülich, Fed. Rep. of Germany

[21] Appl. No.: 498,220

[22] Filed: Mar. 23, 1990

[30] Foreign Application Priority Data

Mar. 25, 1989 [DE] Fed. Rep. of Germany ..... 3909996

[51] Int. Cl.[5] ..... F28F 3/08

[52] U.S. Cl. ..... 165/166; 165/167

[58] Field of Search ..... 165/166, 167, 174, 903

[56] References Cited

U.S. PATENT DOCUMENTS

| | | | |
|---|---|---|---|
| 3,334,399 | 8/1967 | Teeguarden | 165/166 |
| 3,469,615 | 9/1966 | Usher . | |
| 3,631,923 | 1/1972 | Izeki | 165/167 |
| 4,265,302 | 5/1981 | Föster et al. | 165/165 |
| 4,287,945 | 9/1981 | Hessari | 165/167 |
| 4,298,059 | 11/1981 | Krauth et al. | 165/166 |
| 4,370,868 | 2/1983 | Kim et al. | 165/158 |
| 4,589,480 | 5/1986 | Dahlgren | 165/166 |

FOREIGN PATENT DOCUMENTS

| | | | |
|---|---|---|---|
| 166779 | 2/1950 | Austria | 165/166 |
| 2360785 | 6/1975 | Fed. Rep. of Germany . | |
| 3215961 | 11/1983 | Fed. Rep. of Germany | 165/153 |
| 995395 | 11/1951 | France | 165/167 |
| 162185 | 8/1985 | Japan | 165/166 |
| 55584 | 3/1986 | Japan | 165/166 |
| 329714 | 5/1930 | United Kingdom | 165/167 |

*Primary Examiner*—John Rivell
*Assistant Examiner*—L. R. Leo
*Attorney, Agent, or Firm*—Nils H. Ljungman & Associates

[57] ABSTRACT

A ceramic heat transfer device with a heat transfer matrix. The matrix includes gas ducts and fluid ducts which are arranged close to and parallel to each other. Inlet and outlet openings are provided in the boundary wall of the hear transfer matrix to facilitate the inlet and outlet of material. Fluid inlet and outlet slots are provided on both sides of the heat transfer matrix and boundary walls cover guide pockets. This arrangement allows the medium connections to be independent of the dimensions of the heat transfer matrix and provides for guidance of the medium, or material. the ends of the enlarged area of the guide pockets that connect the openings are arranged so that connection nipples are provided for connecting fluid pipes. Gas and fluid webs are provided in slot-like gas and liquid conduits for guidance of gas and fluid.

15 Claims, 5 Drawing Sheets

CERAMIC HEAT EXCHANGER

BACKGROUND OF THE INVENTION

1. Field of the Invention:

The present invention relates to a ceramic heat exchanger for the recuperative heat exchange between a gas and a liquid. The heat exchanger comprises a matrix with slot-like gas ducts and liquid ducts.

2. Background Information:

Recuperative ceramic heat exchangers with slot-like current ducts for medium flow, such as gas and liquid flow, and corresponding inlet and outlet openings are known. Examples of such heat exchangers may be found in German Patent No. 27 07 290 and German Patent No. 28 41 571. In a customary manner, the size of the heat exchanger is determined by the amount, such as number, volume and surface area, of the flow ducts utilized for the heat exchange process. In most of these heat exchangers, there are only small amounts of surface areas remaining for the connection of the pipes through which the medium to be heat exchanged flows. Because the sealing surfaces of the heat exchanger must be flat, and because it is desirable to have equal, or even, current flow through the heat exchanger matrix, a great expenditure must be made to prepare the surfaces to achieve a secure sealing of the connections, even under high medium pressure.

German Laid Open Patent Application No. 23 60 785 discloses a metallic heat transfer device, or heat exchanger, that is structurally configured to remove gas from a liquid that develops gas and is involved in the heat exchange process. Interim walls are positioned for the fluid ducts that are employed to separate the fluid and gas. The connection of the medium pipe at the heat transfer device accommodates the desired separation of media.

OBJECT OF THE INVENTION

One object of the present invention is to produce a simple, medium pipe connection, which is independent of the required area, or dimension, of the heat transfer matrix, such as the surface area where heat exchange occurs, to allow flow of medium through the matrix while, simultaneously, heat transfer occurs. Such a ceramic heat transfer device may be useful, for example, in cooling hot exhaust gases from a turbine, as well as in a variety of other applications.

SUMMARY OF THE INVENTION

This object can be achieved with a ceramic heat transfer device, or heat exchanger, of the type mentioned above, which forms the present invention. Accordingly, for the guidance of the fluid substance flow toward the fluid inlet slots and away from the fluid outlet slots, guide pockets are provided. The guide pockets cover the boundary walls of the heat transfer matrix. Fluid inlet slots and the fluid outlet slots are arranged within those boundary walls. A cross-section of the guide pocket is enlarged, starting at the point of both the fluid inlet slots and the fluid outlet slots, thereby providing an enlarged connection area opening for connecting nipples for the connection of fluid pipes. The cross-section of the guide pockets narrows, thereafter, thereby providing fluid flow guidance. Webs, for additional flow guidance, are provided for the gas ducts and the liquid ducts.

For a better distribution of the fluid, the liquid ducts are equipped with guidance webs that start at the fluid inlet slots where the fluid enters. Also, guide webs are positioned at the outlet fluid slots where the liquid exits. The guide webs generate a turbulent flow in the fluid near the fluid exit, which increases the heat exchange in this area of the heat transfer matrix. With this arrangement, the temperature of the material of which the heat transfer device, or heat exchanger, is constructed can be kept low and the entrance area of the hot gases and the incoming gas will be quickly cooled shortly after entrance into the gas ducts. The webs in the gas ducts run in a straight line from the gas inlet to the gas outlet.

As a further embodiment, the guide pockets, together with the walls that border them and the heat transfer matrix, are integrated in the ceramic heat transfer device so that the guide pockets and the heat transfer matrix form one ceramic block. The simple construction of this block is derived from the wedge-type configuration of the guide pockets and because the fluid inlet and the fluid outlet slots are effectively located in the area of the wedge-type tip of the guide pocket.

The wedge-type configuration of the guide pockets, which are located in the inlet and outlet slots for the heat exchange fluid and the heat transfer matrix at the inlet and the outlet, is achieved by slightly slanting the heat transfer matrix walls, in the heat transfer device. The result, therefore, is the optimal use of space of the heat transfer block. The heat transfer block is closed, appropriately, and is built in a block-like configuration.

A cross-section of the fluid pockets narrow starting from where the fluid enters at the fluid entry slot to the fluid exit slot at the center of the heat transfer matrix. This configuration produces a damming up of fluid that contributes to the equal distribution of the fluid within the center of the heat transfer matrix.

Also, from the fluid exit at the center of the heat transfer matrix to the fluid outlet slots, there is an enlargement of the cross-section that assists in the outflow of the fluids.

Nipples are provided to connect the metallic pipe connections, for the liquid which is to be heated in the heat exchanger, with the connecting openings of the heat transfer device in a simple manner. Long bolts are provided in the guide pockets to hold the nipples in place. The long bolts extend in the free space of the empty guide pockets between the two connecting openings that are located opposite each other. Also provided are additional devices to which the connecting nipples for the fluid pipes can be fastened. A non-rotatable nut is provided to cooperate with the bolts to properly position the connecting nipples. For a water-tight connection, the heat transfer device is equipped with an insertable seal ring. The liquid fluid pipes can be connected, in a simple manner, by means of an inner threading of the connecting nipples. The connecting nipples can also be equipped with caps.

A ventilating device is located in the area of the wedge-type tip of the guide pockets for venting of the area of the heat transfer matrix that contains liquid. This ventilating device can be opened or closed. An automatic ventilator may, also, be added to the ventilating device. In the case of a heat transfer device which has been built in stages or layers, it is appropriate to utilize the layers which comprise the heat transfer device for the development of the heat transfer matrix as well as for the formation of the guide pockets. Wall layers and web layers of the heat transfer device are equipped with corresponding recesses for the formation of heatable flow spaces.

One aspect of the invention resides broadly in a heat exchanger comprising a first chamber which defines a first passageway and a second passageway. The first passageway defines a first cross-section. The second passageway defines a second cross-section. The first chamber, the first passageway and the second passageway each are configured to facilitate fluid passage therethrough. The second chamber is configured to facilitate fluid passage therethrough. The first port is in fluid communication with the first passageway means to facilitate fluid passage from the first port to the first passageway. The second port is in fluid communication with the second passageway to facilitate fluid passage from the second passageway to the second port. The first chamber and the second chamber are relatively positioned to facilitate heat transfer therebetween and to restrict fluid passage therebetween. The first passageway and the second passageway are in fluid communication with one another to facilitate fluid passage from the first passageway to the second passageway. The first passageway is configured with a first end adjacent to the first port. The first passageway is configured with a second end positioned in spaced-apart relation with respect to the first end. The second passageway is configured with a third end adjacent to the second port. The second passageway is configured with a fourth end positioned in spaced-apart relation with respect to the third end. The cross-section of the first passageway defines a first dimension adjacent the first end, the cross-section of the first passageway defines a second dimension adjacent the second end, the first dimension being greater than the second dimension. The cross-section of the second passageway defines a third dimension adjacent the third end. The cross-section of the second passageway defines a fourth dimension adjacent the fourth end, the third dimension being greater than the fourth dimension, whereby the first passageway narrows in the direction from the first end toward the second end and the second passageway narrows in the direction from the third end toward the fourth end.

BRIEF DESCRIPTION OF THE DRAWINGS

The following Description of the Preferred Embodiment may be better understood when taken in conjunction with the appended drawings in which.

DESCRIPTION OF THE PREFERRED EMBODIMENT

Figure 1:
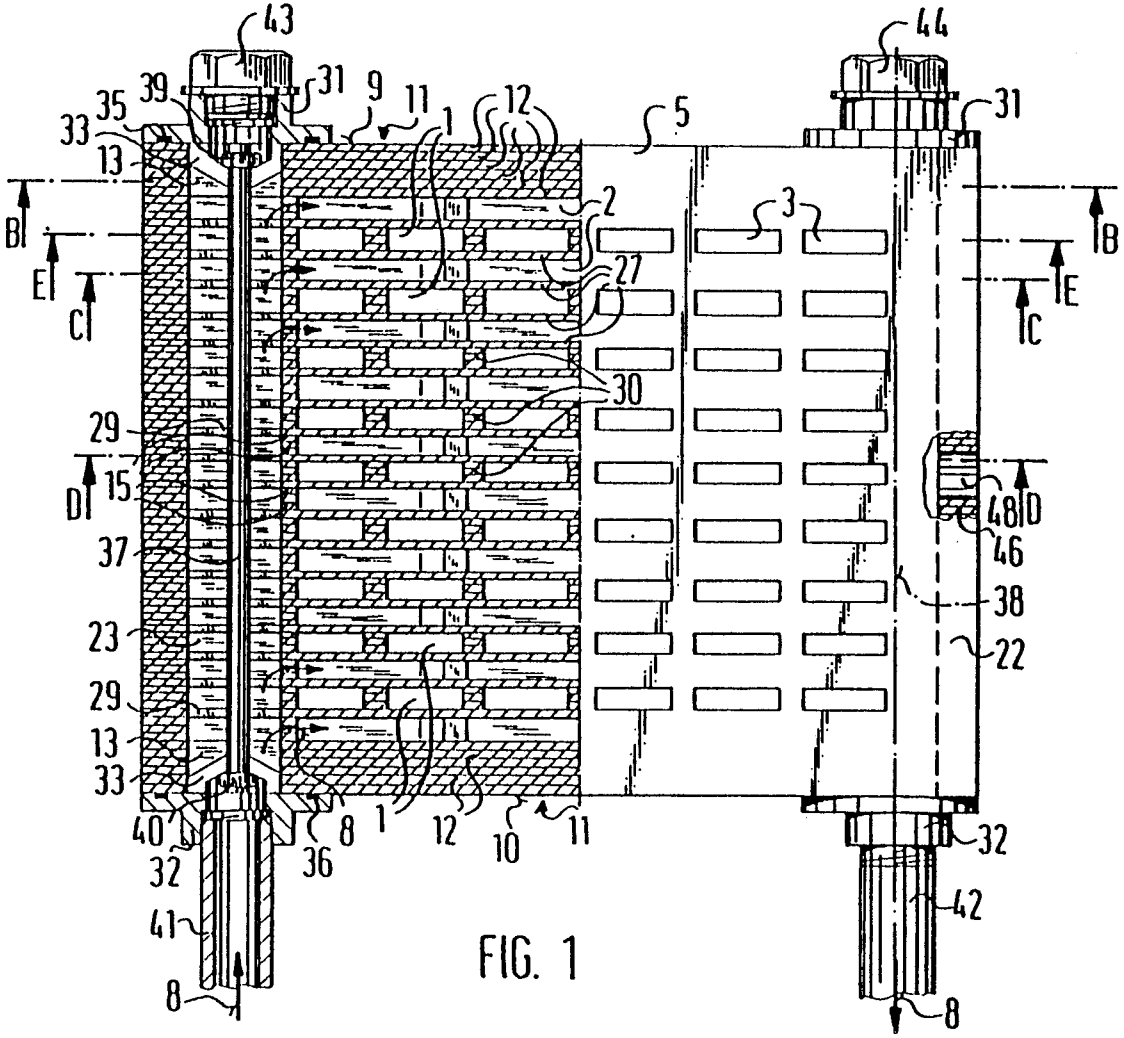
FIG. 1 is a partial cross-sectional view, and partial side elevational view of the heat transfer device of the present invention, taken along line A/A of FIG. 2.

As shown in FIG. 1, a preferred embodiment of the claimed heat transfer device, or heat exchanger, 50 shown is a ceramic heat transfer device which is produced in a layer-type construction as described below. Heat transfer device 50 consists of individual ceramic layers, that are provided for the purpose of developing fluid flow spaces and have recesses for the medium that flows in the heat exchanger. The individual layers are assembled together into a multi-layer unit, thereby forming hollow spaces that are bordered by interim walls. The hollow spaces form the passage in which the medium can be guided and in which heat exchange can occur. The layers are assembled in a green, or uncured, condition of ceramic material and become fixed to each other through known ceramic forming processes. The uncured heat transfer device, as described above, will be sintered and will turn into a homogenous ceramic block with fluid tight walls between the flow spaces for the medium.

Silicone carbide and silicone nitride are ceramic materials that are especially suitable for the production of the above described heat transfer device.

The individual ceramic layers, that are employed to form the heat transfer device, are shown in their finally built sequence in the heat transfer device depicted in FIG. 1. FIGS. 2 through 5 depict the individual layers that are employed to form the device of FIG. 1.

FIG. 1 shows a partial cross-section of heat transfer device 50. Heat transfer device 50 comprises gas ducts 1 and liquid ducts 2 that are employed for the flow of the medium that is to be located in heat transfer device 50. In a preferred embodiment, water is heated by hot gas in heat transfer device 50. The hot gas acts as a heat carrier and flows through gas ducts 1 from inflow openings 3. The gas then flows to discharge openings 4 which are located opposite of face sides 5 and 6 of heat transfer device 50, as shown in FIG. 5.

Figure 5:
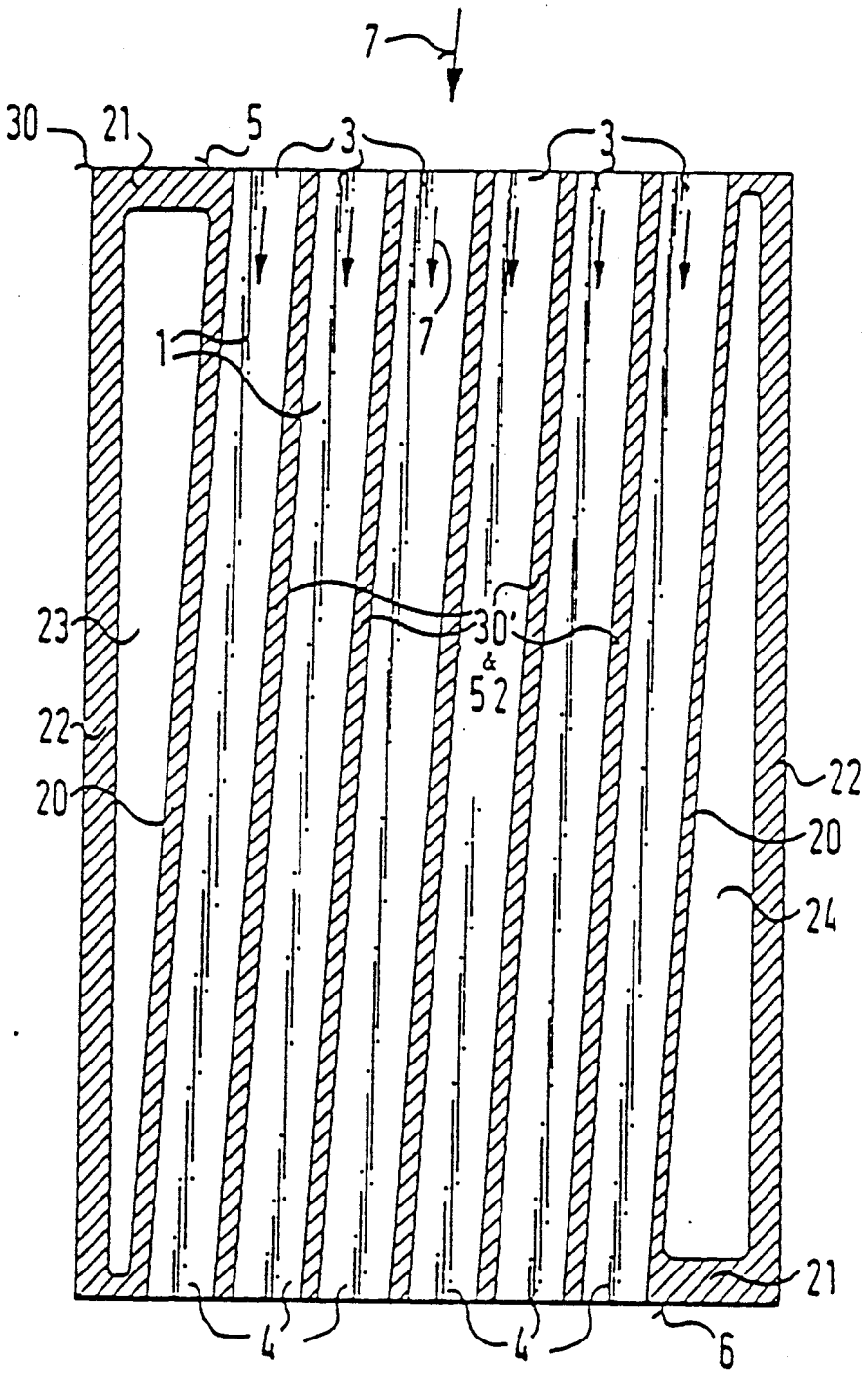
FIG. 5 is a cross-sectional view of the heat transfer device of FIG. 1, taken along line E/E of FIG. 1.

The flow direction of the gas within gas ducts 1 is shown by arrow 7 in FIG. 5. In FIG. 1, the slot-like arrangement of gas ducts 1 are shown.

The water to be warmed will be moved into the inner part of heat transfer device 50 through liquid ducts 2. Liquid ducts 2, likewise, are configured in a slot-like arrangement. Gas ducts 1 and liquid ducts 2 are employed to facilitate the heat exchange between the hot gas and the water to be warmed in the heat transfer matrix. The flow direction of the water through heat exchange, or transfer, device 50 is marked by arrows 8, as shown in FIGS. 1 and in 3. In a preferred embodiment, the water flows in a direction that is opposite to the direction of the hot gas in gas ducts 1.

Figure 2:
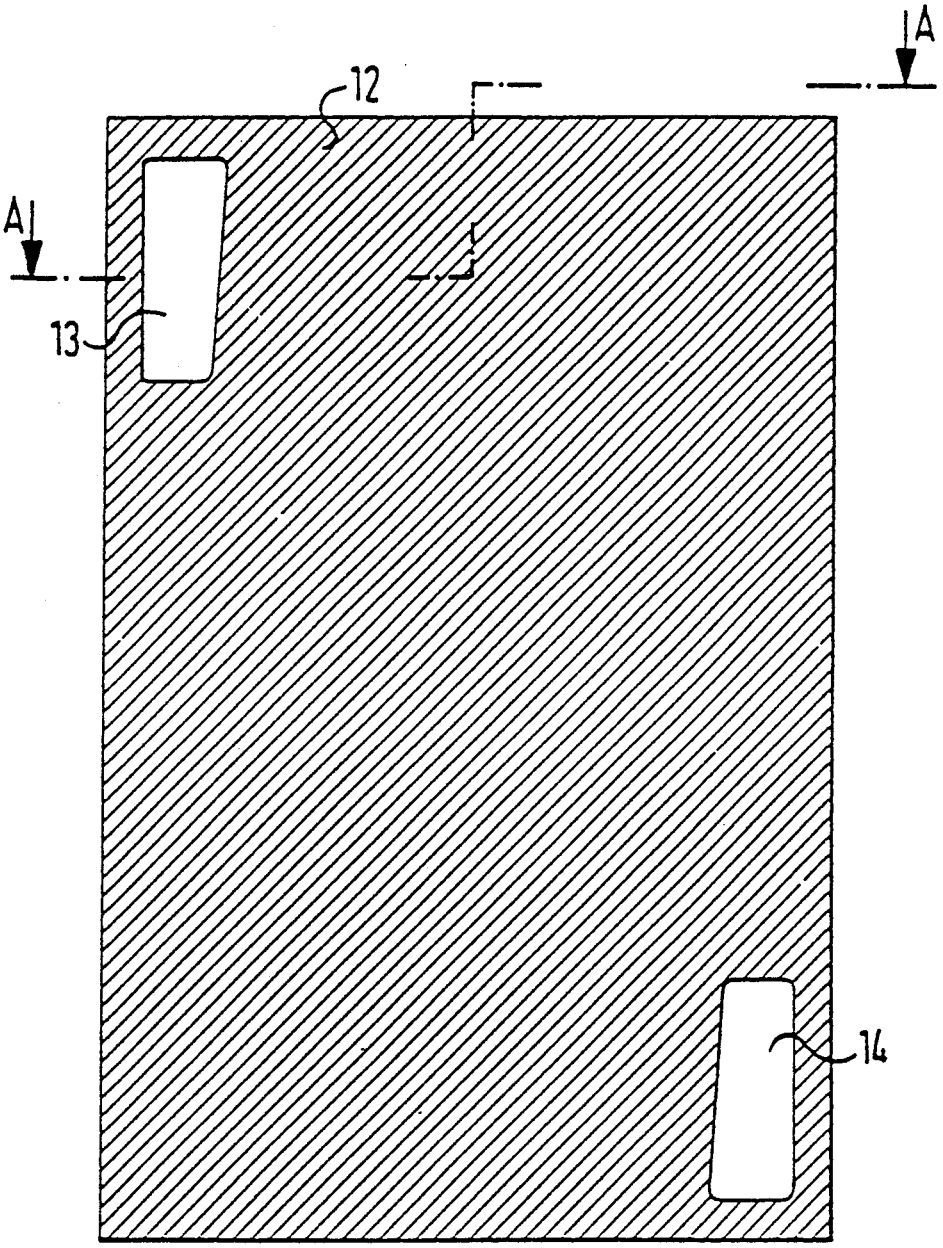
FIG. 2 is a cross-sectional view of the heat transfer device of FIG. 1, taken along line B/B of FIG. 1.

The water, that is to be warmed, will be input to and removed from heat transfer device 50 through longitudinal sides 9 and 10. Longitudinal sides 9 and 10 are, generally, perpendicular to face sides 5 and 6. Longitudinal walls 11, that are connected to longitudinal sides 9 and 10, are formed from wall layers 12 as shown in FIG. 2. Wall layers 12 have a recess for the formation of connection openings 13 and 14, for the inlet and outlet of the water that is to be warmed within heat transfer device 50. A description of the connection of the water pipes to heat transfer device 50 is presented below.

Figure 3:
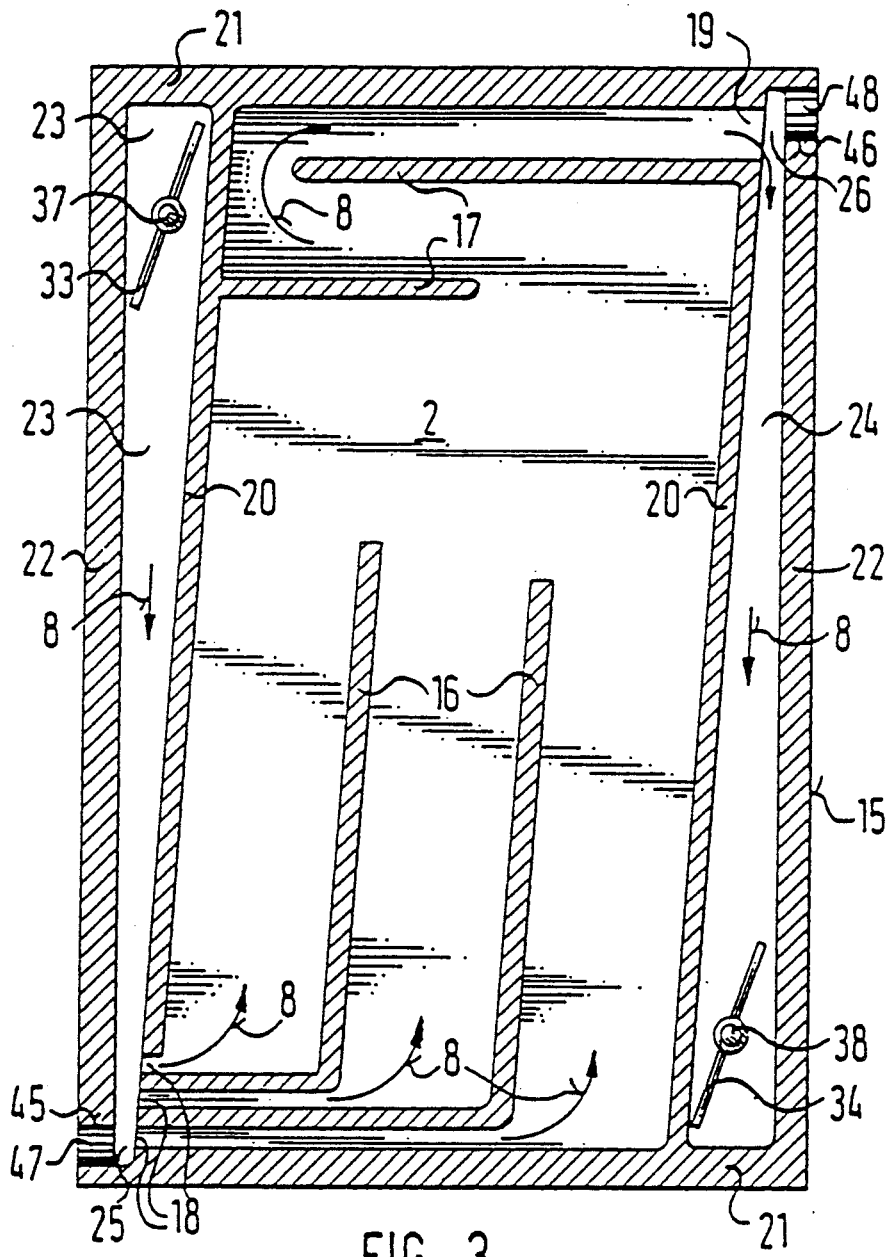
FIG. 3 is a cross-sectional view of the heat transfer device of FIG. 1, taken along line C/C of FIG. 1.

In a preferred embodiment of the present invention, six wall layers 12 are stacked to form longitudinal wall 11. Web layers 15, which are multilayers, are employed within heat transfer device 50 to configure the fluid ducts for the water. FIG. 3 shows layers of webs 15. Guiding web 16 and deflection web 17 are provided for the guidance of the water to be warmed within fluid channel 2. Guidance webs 16 start at the fluid inlet slot 18 and are employed for the universal distribution of the water through the cross-section of liquid ducts 2. Deflection webs 17 are located in front of liquid outlet slots 19 and are provided for the purpose of creating turbulence in the water thereby improving the transfer of heat in this area.

Web layers 15 are employed to form boundary walls 20, for the heat transfer matrix and outer walls 21 and 22 are employed in the formation of heat transfer device 50. Web 17 may be connected to face wall 21.

There are additional recesses between boundary wall 20, of the heat transfer matrix, and longitudinal walls 22. Those boundaries are indented, or recessed, and are provided to form guide pocket 23, where the water enters the heat transfer matrix, or guide pocket 24, where the warmed water is discharged. As described above, arrows 8, in FIG. 3, show the direction of flow of the water. In the embodiment shown, guide pockets 23 and 24 have been formed in a wedge-shaped configuration so that inlet slots 18 and outlet slots 19 each are located in the area of the wedge-shaped tip 25 and 26, respectively, of guide pockets 23 and 24.

Figure 4:
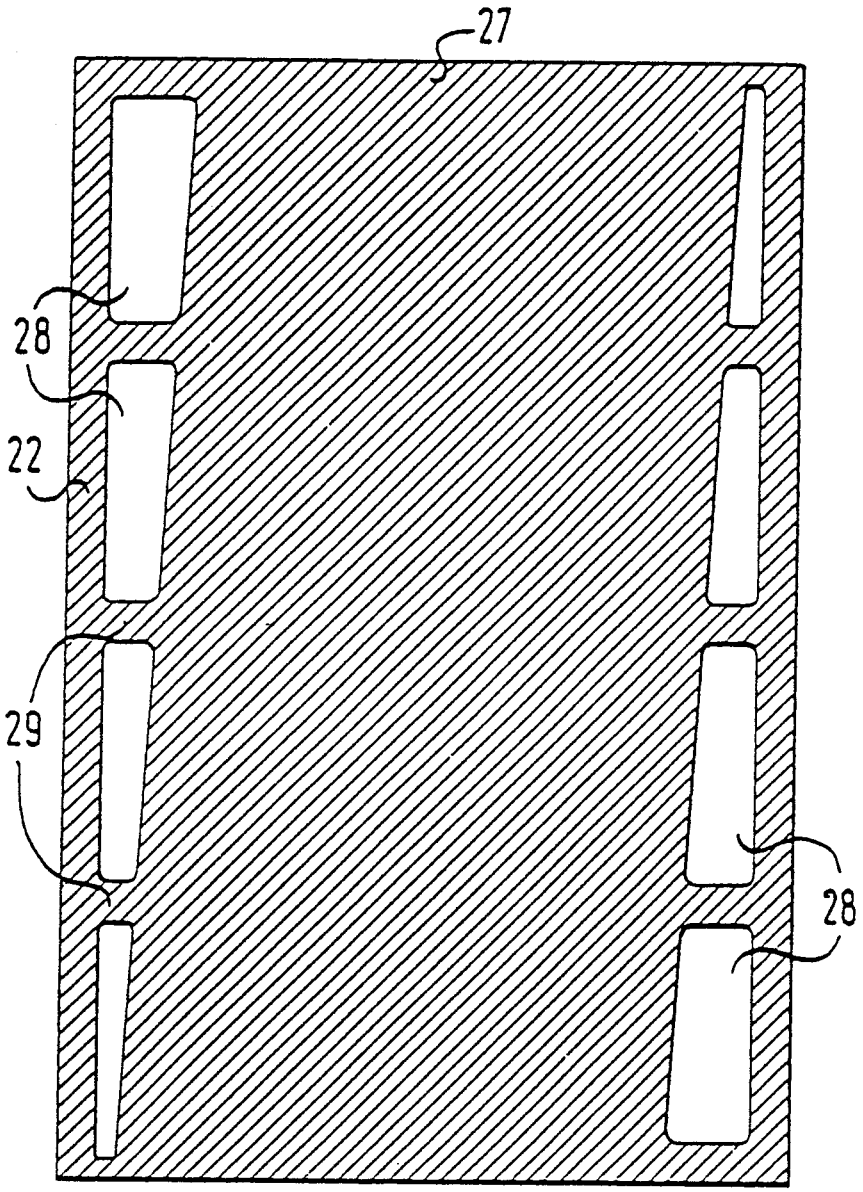
FIG. 4 is a cross-sectional view of the heat transfer device of FIG. 1, taken along line D/D of FIG. 1.

In a preferred embodiment, three web layers 15 are stacked for forming fluid duct 2. Web layers 15, as illustrated in FIG. 3, are physically followed, in sequence, during the assembly of ceramic heat transfer device 50, by wall layer 27, as illustrated in FIG. 4. Liquid duct 2 is to be covered with ceramic wall layer 27 in the area of the heat transfer matrix. Simultaneously, heat exchange between the water and the hot gases occurs above wall layer 27. Wall layer 27 constitutes the boundary wall between gas ducts 1 and fluid ducts 2. Wall layer 27 has recesses 28 in its boundary area. Recesses 28 provide a channel for the distribution of the water inside of guide pockets 23 and 24. Webs 29, between recesses 28, take the generated mechanical stress, or load, which is generated due to the high liquid pressure which exists in guide pockets 23 and 24, relative to the ambient pressure in the wall area of heat transfer device 50, and transfers the stress to longitudinal wall 22 and boundary walls 20.

Web layer 30 defines gas ducts 1 as shown in FIG. 5. Web 30 defines webs 52 that direct hot gas through ceramic heat transfer device 50. Webs 52 may be arranged to be parallel to one another. The direction of the gas flow through ceramic heat transfer device 50 is indicated by arrows 7. Guide pockets 23 and 24 are located in the border area of web layer 30 and provide the channel through which the water will flow.

Since guide pockets 23 and 24 are adjacent to gas ducts 1, a heat exchange occurs between the fluid and the hot gases. The outer portions of web layer 30 defines outer, or face, walls 21 and 22 of heat transfer device 50.

Wall layer 27, as shown in FIG. 4, is attached to web layer 30. Web layer 30, which defines gas ducts 1, comprises three stacked layers, as shown in the preferred embodiment. Next, in sequence, web layer 15, as shown in FIG. 3 and which defines fluid ducts 2, are provided. Next, an additional wall layer 27 is provided. Once the prescribed number of gas ducts 1 and fluid ducts 2 is assembled, wall layers 12, as shown in FIG. 2, and which include connection openings 13 and 14 for the introduction or removal of the water, are attached.

Wall layers 12 enclose heat transfer device 50 on its longitudinal side 10, as shown in FIG. 1. Six wall layers 12 form longitudinal wall 11. During the stacking of layers of the wall and web layers, guide pockets 23 and 24, with their wedge-type formation, are attached on both sides to the heat transfer matrix. The resultant heat transfer device 50 provides tilted or sloping, walls 52, in contrast to the rectangular outer walls of heat transfer device 50. Thus, walls 52 meet the outer walls of heat transfer device 50 at an angle and results in a wedge-type configuration for guide pockets 23 and 24.

This configuration of guide pockets 23 and 24 permits a good distribution of the water in its area of entry and exit of heat transfer device 50. This configuration, also, provides a continuous flow area for the water whereby the water enters into the heat transfer matrix, is warmed and then leaves the heat transfer matrix.

Connecting openings 13 and 14 of guide pockets 23 and 24, as shown in FIG. 1, provide connection nipples 31 and 32 that are held in place by holding elements 33 and 34. Seal rings 35 and 36 are closely fitted to connection openings 13 and 14 by means of anchoring rods 37 and 38 and screw adaptors 39 and 40. Anchoring rods 37 and 38 penetrate the free space of the guide pockets 23 and 24 and are anchored to connection openings 13 and 14, which are situated across from each other. When anchoring rods 37 and 38 are screwed through screw adapters 39 and 40, holding elements 33 and 34 prevent rotation of screw adapters 39 and 40 since holding elements 33 and 34 are mechanically attached to screw adapters 39 and 40 and, as shown in FIG. 3, are wider than the width of guide pockets 23 and 24.

Connection nipples 31 and 32 are provided on each side of heat transfer device 50. Fluid pipes 41 and 42 may be connected to each of connection nipples 31 and 32 or, as shown in FIG. 1, may be connected to only one inlet nipple, either 31 or 32, and one outlet nipple, either 31 or 32, as shown in FIG. 1. When one or two nipples 31 and 32 are not connected to fluid pipes, plugs 43 and 44 may be provided to cover nipples 31 and 32 to prevent the escapage of the water therefrom.

For the venting of the water carrying areas of heat transferring device 50, ventilating devices 45 and 46 may be provided in the area of wedge-shaped tips 25 and 26 of guide pockets 23 and 24. In the embodiment shown, venting devices 45 and 46 are closed off with plugs 47 and 48. It is, however, possible to attach automatic venting devices (not shown) that are well known in the art.

After all wall layers and web layers 12, 15, 27 and 30 have been assembled in the "green condition" (not cured), heat transfer device 50 would then be sintered according to known ceramic curing techniques to be formed into a homogenous gas and water tight ceramic heat transfer, or heat exchange, device.

With the embodiment of the invention described above, with individual layers of the heat transfer matrix, guide pockets 23 and 24 that are adapted for guiding fluid, are integrated into heat transfer device 50.

In summary, one feature of the invention resides broadly in a heat transfer device for the heat exchange between a gaseous and a liquid material stream with a matrix related to heat transfer, with liquid conduits and gas conduits which are mounted adjacent to each other and run parallel to each other and are equipped with fluid inlet and fluid outlet slots in the area of the boundary walls of the matrix related to heat transfer, which covers the gas and liquid conduit at the edge of the slots, is characterized by the fact that for the guidance of the liquid material stream in the liquid inlet and liquid outlet slots 18, 19 which are located on both sides of the matrix related to heat transfer which covers the guide pockets 23, 24 which cross-section starting with the liquid inlet and liquid outlet slots 18, 19 is being enlarged so that at the end of the enlarged area of the guide pocket 23, 24 there are connection openings 13, 14 with connection nipples 31, 32 for the connection of the liquid line 41, 42 and that the slot-type gas and fluid conduits 1, 2 as well as webs 16, 17, 29, 30' are planned for the guidance of gas and fluid.

Another feature of the invention resides broadly in a ceramic heat transfer device which is characterized by the fact that the guiding webs 16 start near the fluid inlet slot 18 serve for the introduction of the fluid and are attached to the deflection web 17 and in front of fluid outlet slot 19.

Yet another feature of the invention resides broadly in a ceramic heat transfer device which is characterized by the fact that webs 52 which are located in the gas conduit 1, are in a straight line from the gas inlet at the inlet opening 3, for the gas outlet at exit opening 4.

A further feature of the invention resides broadly in a ceramic heat transfer device which is characterized by the fact that guidance pockets 23, 24 are integrated with the boundary walls and the matrix related to heat transfer into one homogenous ceramic heat transfer device.

A yet further feature of the invention resides broadly in a ceramic heat transfer device which is characterized by the fact that guide pockets 23, 24 are built in a wedge-type form.

Yet another further feature of the invention resides broadly in a ceramic heat transfer device which is characterized by the fact that for the connection of the fluid lines 41, 42 to the guide pockets 23, 24 anchoring rods 37, 38 are planned to connect the diagonal connection opening 13, 14 through the guide pockets 23, 24 and on which 39, 40 have connection nipple 31, 32 with a hold to prevent rotation 33, 34 is connected water-tight whereby the connection nipples 31, 32 for the fluid lines 41, 42 or plugs 43, 44 can be attached.

An additional feature of the invention resides broadly in a ceramic heat transfer device which is characterized by the fact that the guide pockets 23, 24 shown ventilation devices 45, 46 which are located in the area of the wedge-type tip 25, 26.

A yet additional feature of the invention resides broadly in a ceramic heat transfer device which is characterized by the fact that there is a layer-type build-up whereby the ceramical layers 12, 15, 27, 30 which constitute the heat transfer device, also form the matrix related to heat transfer and the guide pockets 23, 24, and for the embodiment of the current cavities within the wall layers 12, 27 and web layers 15, 30 show a recess corresponding to the current chambers.

Some examples of ceramics can be found in U.S. Pat. No. 4,812,334, entitled "Process For Sealing Ceramic Heat Exchangers"; U.S. Pat. No. 4,789,585, entitled "Heat Transfer Block For Cross Flow Heat Exchanger"; U.S. Pat. No. 4,787,443, entitled "Ceramic Heat Exchanger Element"; U.S. Pat. No. 4,768,586, entitled "Ceramic Heat Exchangers"; U.S. Pat. No. 4,681,157, entitled "Crossflow Heat Exchanger"; U.S. Pat. No. 4,632,181, entitled "Ceramic Heat Exchanger"; U.S. Pat. No. 4,433,092, entitled "Green Ceramic of Lead-Free Glass, Conductive Carbon, Silicone Resin And AlPO(4), Useful, After Firing, As An Electrical Resistor"; U.S. Pat. No. 4,353,958, entitled "Green Ceramic Tapes And Method Of Producing Them"; U.S. Pat. No. 4,259,061, entitled "Method Of Achieving Uniform Sintering Shrinkage In A Laminated Planar Green Ceramic Substrate And Apparatus Therefor"; U.S. Pat. No. 4,010,133, entitled "Low-Fire Green Ceramic Articles And Slip Compositions For Producting Same"; U.S. Pat. No. 4,020,134, entitled "Method For Preparing Shaped Green Ceramic Compacts"; U.S. Pat. No. 4,812,334, entitled "Process For Sealing Ceramic Heat Exchangers"; U.S. Pat. No. 3,962,621, entitled "Rigidly Bonded Green Ceramics And Processes"; U.S. Pat. No. 4,746,635, entitled "High Strength And High Hardness Alumina-Zirconia-Silicon Carbide Sintered Ceramic Composite And Its Manufacturing Process"; U.S. Pat. No. 4,886,767, entitled "Silicon Nitride-Ceramic And A Manufacturing Method Thereof"; U.S. Pat. No. 4,876,227, entitled "Reaction Sintered Boride-Oxide-Silicon Nitride For Ceramic Cutting Tools"; U.S. Pat. No. 4,834,926, entitled "Process For Producing Silicon Nitride Ceramic Articles"; U.S. Pat. No. 4,500,482, entitled "Method Of Manufacture Silicon Nitride Ceramic Molded Articles" and U.S. Pat. No. 4,347,089, entitled "Method For Bonding Silicon Nitride."

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiment is not to be taken as limited to all of the provided details thereof, since modifications and variations thereof may be made without departing from the spirit and scope of the invention.

What is claimed is:

1. A heat exchanger comprising:

first chamber means defining first passageway means and second passageway means, said first passageway means defining a first cross-section, said second passageway means defining a second cross-section, said first chamber means, said first passageway means and said second passageway means each being configured to facilitate fluid passage therethrough;

second chamber means configured to facilitate fluid passage therethrough;

first port means in fluid communication with said first passageway means to facilitate fluid passage from said first port means to said first passageway means; and second port means in fluid communication with said second passageway means to said second port means;

said first chamber means and said second chamber means being relatively positioned to facilitate heat transfer therebetween and to restrict fluid passage therebetween;

fluid communication means disposed between said first passageway means and said second passageway means;

said first passageway means and said second passageway means being in fluid communication with one another via said fluid communication means to facilitate fluid passage from said first passageway means to said second passageway means;

said first passageway means configured with a first end adjacent said first port means, said first passageway means configured with a second end positioned in spaced-apart relation with respect to said first end;

said fluid communication means having a first side portion and a second side portion;

said first passageway means being disposed along said first side portion of said fluid communication means;

said first passageway means being configured to provide fluid flow from said first port means along said first side portion;

orifice means being disposed at said second end position of said first passageway means;

said orifice means being disposed to admit fluid flow to said fluid communication means in a direction transverse to flow of the fluid in said first passageway means;

said second passageway means configured with a third end adjacent said second port means, said second passageway means configured with a fourth end positioned in spaced-apart relation with respect to said third end;

said cross-section of said first passageway means defining a first dimension adjacent said first end, said cross-section of said first passageway means defining a second dimension adjacent said second end, said first dimension being greater than said second dimension;

said first passageway means narrowing in the direction from said first end toward said second end;

spacer means for being interposed between said first chamber means and said second chamber means for restricting fluid passage therebetween;

a plurality of first chamber means, a plurality of second chamber means and a plurality of spacer means said first chamber and said second chamber means being alternately interposed one with the other;

at least one spacer means is for being interposed between each of said first and second chamber means;

said first chamber means, said first passageway means and said second passageway means each are configured for liquid passage therethrough;

said second chamber means is configured for gas passage therethrough;

said first chamber means defines interior cavity means, said interior cavity means having a central portion interposed between and in fluid communication with a first passageway means and said second passageway means, said first communication means comprising said central portion of said interior cavity means;

third passageway means for said passage of gas therethrough.

2. The heat exchanger of claim 1, further including deflector means positioned within said interior cavity means, said deflector means comprising means for: a) guiding the fluid passing through said interior cavity means, and b) turbulating the fluid passing through said interior cavity means.

3. The heat exchanger of claim 2, wherein said interior cavity means facilitates fluid passage from said first passageway means to said second passageway means.

4. The heat exchanger of claim 3, wherein said second chamber means comprises:

fourth passageway means for being in fluid communication with said first passageway means for facilitating the exchange of fluid therebetween; and fifth passageway means for being in fluid communication with said second passageway means for facilitating the exchange of fluid therebetween.

5. The heat exchanger of claim 4, wherein said spacer means comprises:

sixth passageway means for being in fluid communication with said first passageway means and said fourth passageway means for facilitating fluid flow therebetween; and seventh passageway means for being in fluid communication with said second passageway means and said fifth passageway means for facilitating fluid flow therebetween.

6. The heat exchanger of claim 5, wherein:

said fourth passageway means and said sixth passageway means each define a cross-section that at least partially approximates said first cross-section of said first passageway means; and said fifth passageway means and said seventh passageway means each define a cross-section that at least partially approximates said second cross-section of said second passageway means.

7. The heat exchanger of claim 6, wherein said first cross-section and said second cross-section each are at least partially generally wedge-shaped.

8. The heat exchanger of claim 7, wherein:

said first port means is configured to mate with first nipple means; and said second port means is configured to mate with second nipple means.

9. The heat exchanger of claim 8, further including first web means for partioning said third passageway means into a plurality of gas passages.

10. The heat exchanger of claim 9, wherein:

at least a first said deflector means is provided for guidance of fluid in said first chamber means, said at least first deflector means beginning adjacent said second end of said first passageway means and terminating in the vicinity of said central portion of said interior cavity; and at least a second deflector means is provided for turbulating the fluid in said first chamber means, said at least second deflector means being positioned at least partially between said first end of said first passageway means and said fourth end of said second passageway means.

11. The heat exchanger of claim 10, wherein said first chamber means and said second chamber means are formed at least partially of a ceramic material.

12. The heat exchanger of claim 11, wherein:

said gas passages of said third passageway means each comprise an inlet and an outlet;

each said web means extends generally from at least one inlet to at least one outlet; and each said web means defines at least one generally straight surface.

13. The heat exchanger of claim 12, wherein said first chamber means, said second chamber means and said spacer means form a homogeneous unit.

14. The heat exchanger of claim 13, further including end wall means to at least partial bound the perimeter of said heat exchanger.

15. The heat exchanger of claim 14, further including:

bolt means for being positioned adjacent at least one of said first end, second end, third end and fourth end, said bolt means for being positioned at least partially within at least one of said first passageway means and said second passageway means; and nut means for mating with said bolt means, said nut means for being positioned in at least one of said first passageway means and said second passageway means;

wherein said bolt means and said nut means at least mate at least one of said first nipple means and said second nipple means in fluid-tight contact with said heat exchanger; and wherein said nut means is configured to limit rotation.

* * * * *

UNITED STATES PATENT AND TRADEMARK OFFICE

CERTIFICATE OF CORRECTION

PATENT NO. : 5,063,995

DATED : November 12, 1991

INVENTOR(S) : Siegfried FORSTER and Peter QUELL

It is certified that error appears in the above-identified patent and that said Letters Patent is hereby corrected as shown below:

On the title page (face of the patent), by the Inventor's Section indicated by the INID code [75], after 'Förster,', delete "Ottenfeld;" and insert --Alsdorf;--.

On the title page (face of the patent), by the Inventor's Section indicated by the INID code [75], after 'Quell,', delete "Birkenweg" and insert --Aachen,--.

On the title page (face of the patent), under the Abstract section indicated by the INID code [57], line 11, after 'material.', delete "the" and insert --The--.

In column 4, line 43, after the first instance of 'in', delete "FIGS. 1 and in 3." and insert --Figure 1 and in Figure 3.--.

In Claim 1, line 17, after 'means', insert --to facilitate fluid passage from said second passageway means--.

Signed and Sealed this

Sixteenth Day of March, 1993

*Attest:*

STEPHEN G. KUNIN

*Attesting Officer*

*Acting Commissioner of Patents and Trademarks*